US011430593B2

(12) United States Patent
Hirukawa

(10) Patent No.: US 11,430,593 B2
(45) Date of Patent: Aug. 30, 2022

(54) MULTILAYER COIL COMPONENT

(71) Applicant: Murata Manufacturing Co., Ltd., Kyoto-fu (JP)

(72) Inventor: Atsuo Hirukawa, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 423 days.

(21) Appl. No.: 16/806,876

(22) Filed: Mar. 2, 2020

(65) Prior Publication Data

US 2020/0286663 A1 Sep. 10, 2020

(30) Foreign Application Priority Data

Mar. 4, 2019 (JP) ..... JP2019-038542

(51) Int. Cl.

| | |
|---|---|
| ***H01F 17/00*** | (2006.01) |
| ***H01F 27/29*** | (2006.01) |
| ***H01F 27/32*** | (2006.01) |
| ***H01F 41/04*** | (2006.01) |

(52) U.S. Cl.
CPC ..... *H01F 17/0013* (2013.01); *H01F 27/292* (2013.01); *H01F 27/324* (2013.01); *H01F 41/041* (2013.01)

(58) Field of Classification Search
CPC ... H01F 17/0013; H01F 27/292; H01F 27/324
See application file for complete search history.

(56) References Cited

U.S. PATENT DOCUMENTS

2017/0345552 A1 11/2017 Nakano et al.

FOREIGN PATENT DOCUMENTS

| | | | |
|---|---|---|---|
| JP | H04-077213 | U | 7/1992 |
| JP | 2000-003813 | A | 1/2000 |
| JP | 2017-212372 | A | 11/2017 |

OTHER PUBLICATIONS

An Office Action; "Notice of Reasons for Refusal," mailed by the Japanese Patent Office dated Nov. 30, 2021, which corresponds to Japanese Patent Application No. 2019-038542 and is related to U.S. Appl. No. 16/806,876 with English translation.

*Primary Examiner* — Dinh T Le
(74) *Attorney, Agent, or Firm* — Studebaker & Brackett PC

(57) ABSTRACT

A multilayer coil component includes a multilayer body that is formed by stacking a plurality of insulating layers on top of one another and that has a coil built into the inside thereof; and a first outer electrode and a second outer electrode that are electrically connected to the coil. The coil is formed by electrically connecting a plurality of coil conductors, which are stacked together with insulating layers, to one another. When a coil axis is assumed that is parallel to the length direction and penetrates from the first end surface to the second end surface of the multilayer body, all the coil conductors are arranged so that circles centered on center points of the coil conductors and having diameters that are less than or equal to around 20% of a coil diameter overlap a circumference of a virtual circle centered on the coil axis.

6 Claims, 6 Drawing Sheets

MULTILAYER COIL COMPONENT

CROSS-REFERENCE TO RELATED APPLICATION

This application claims benefit of priority to Japanese Patent Application No. 2019-038542, filed Mar. 4, 2019, the entire content of which is incorporated herein by reference.

BACKGROUND

Technical Field

The present disclosure relates to a multilayer coil component.

Background Art

As an example of a multilayer coil component, Japanese Unexamined Patent Application Publication No. 2000-3813 discloses a multilayer inductor in which a coil is formed in a stacking direction by alternately stacking conductor patterns and electrically insulating layers and sequentially connecting the end portions of the conductor patterns. The conductor patterns are arranged so that a winding start part and a winding end part are located at halfway positions on opposite sides from each other with respect to the approximate center of a cross section of the inductor and so that the conductor patterns gradually advance toward the opposite side from the winding start part toward the winding end part. According to Japanese Unexamined Patent Application Publication No. 2000-3813, variations in an L value arising from positional variations can be suppressed and the Q value can be made high.

In response to the increasing communication speed and miniaturization of electronic devices in recent years, it is demanded that multilayer inductors have satisfactory radio-frequency characteristics in a radio-frequency band (for example, a GHz band extending from around 30 GHz). However, the radio-frequency characteristics of the multilayer inductor disclosed in Japanese Unexamined Patent Application Publication No. 2000-3813 are not satisfactory when the multilayer inductor is used as a noise absorbing component particularly in a radio-frequency range extending from around 30 GHz. In addition, there are problems in that the device is increased in size in order to allow the coil conductors to advance in a fixed direction and the radio-frequency characteristics are degraded due to extra stray capacitances being generated as a result of outer electrodes being provided on entire end surfaces of the electrically insulating body.

SUMMARY

Accordingly, the present disclosure provides a multilayer coil component that realizes excellent radio-frequency characteristics without an increase in the volume of the component.

A multilayer coil component according to a preferred embodiment of the present disclosure includes a multilayer body that is formed by stacking a plurality of insulating layers on top of one another and that has a coil built into the inside thereof; and a first outer electrode and a second outer electrode that are electrically connected to the coil. The coil is formed by electrically connecting a plurality of coil conductors, which are stacked together with insulating layers, to one another. The multilayer body has a first end surface and a second end surface, which face each other in a length direction, a first main surface and a second main surface, which face each other in a height direction perpendicular to the length direction, and a first side surface and a second side surface, which face each other in a width direction perpendicular to the length direction and the height direction. The first outer electrode is arranged so as to cover part of the first end surface and so as to extend from the first end surface and cover part of the first main surface. The second outer electrode is arranged so as to cover part of the second end surface and so as to extend from the second end surface and cover part of the first main surface. The first main surface is a mounting surface. A stacking direction of the multilayer body and an axial direction of the coil are parallel to the mounting surface. Repeating shapes of the coil conductors are substantially circular shapes in a plan view in the stacking direction. When a coil axis is assumed that is parallel to the length direction and penetrates from the first end surface to the second end surface of the multilayer body, all the coil conductors are arranged so that circles centered on center points of the coil conductors and having diameters that are less than or equal to around 20% of a coil diameter overlap a circumference of a virtual circle centered on the coil axis.

According to the preferred embodiment of the present disclosure, a multilayer coil component can be provided that realizes excellent radio-frequency characteristics without an increase in the volume of the component.

Other features, elements, characteristics and advantages of the present disclosure will become more apparent from the following detailed description of preferred embodiments of the present disclosure with reference to the attached drawings.

DETAILED DESCRIPTION

Hereafter, a multilayer coil component according to an embodiment of the present disclosure will be described. However, the present disclosure is not limited to the following embodiment and the present disclosure can be applied with appropriate modifications within a range that does not alter the gist of the present disclosure. Combinations consisting of two or more desired configurations among the configurations described below are also included in the scope of the present disclosure.

Figure 1:
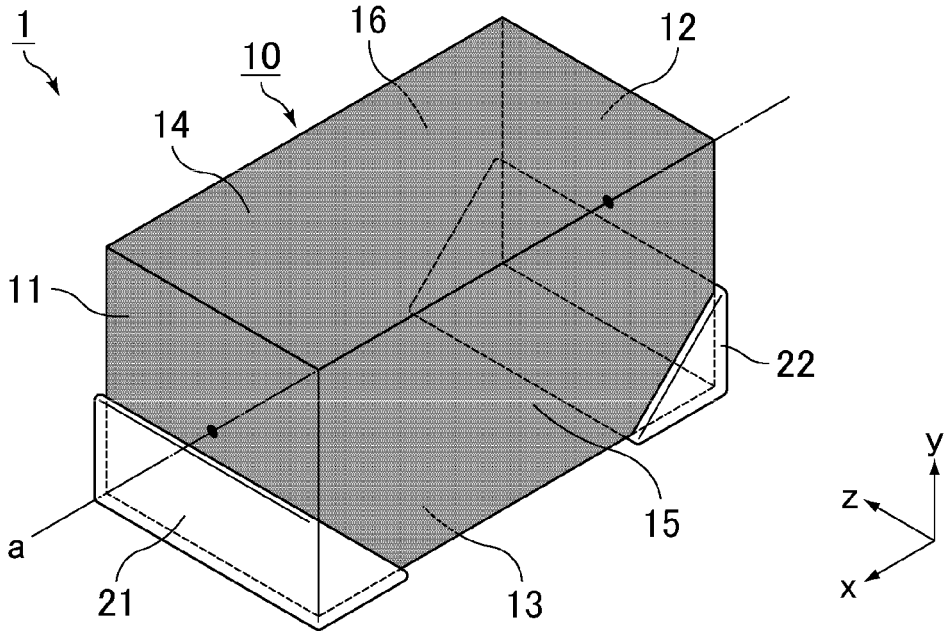
FIG. 1 is a perspective view schematically illustrating a multilayer coil component according to an embodiment of the present disclosure.
Figure 2A:
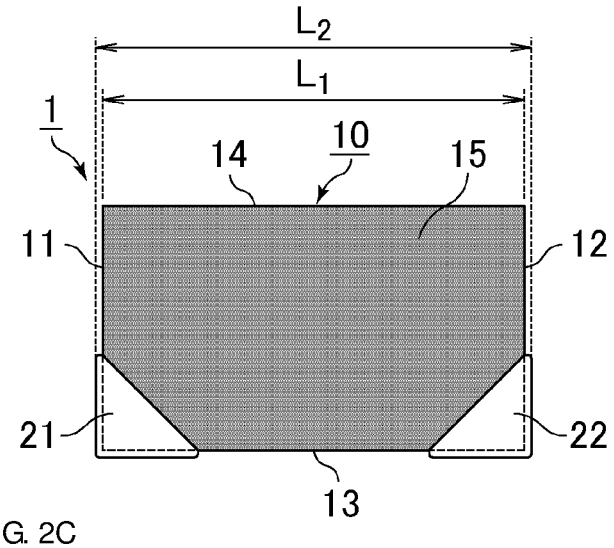
FIG. 2A is a side view of the multilayer coil component illustrated in FIG. 1.
Figure 2B:
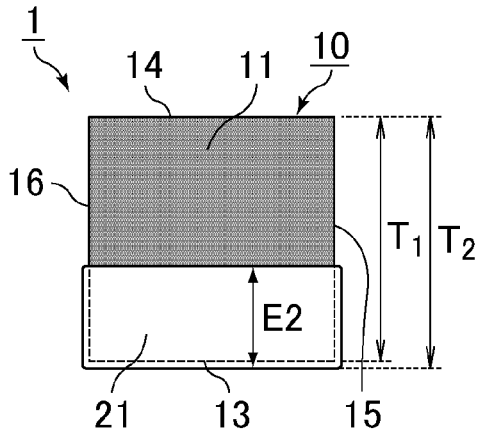
FIG. 2B is a front view of the multilayer coil component illustrated in FIG. 1.
Figure 2C:
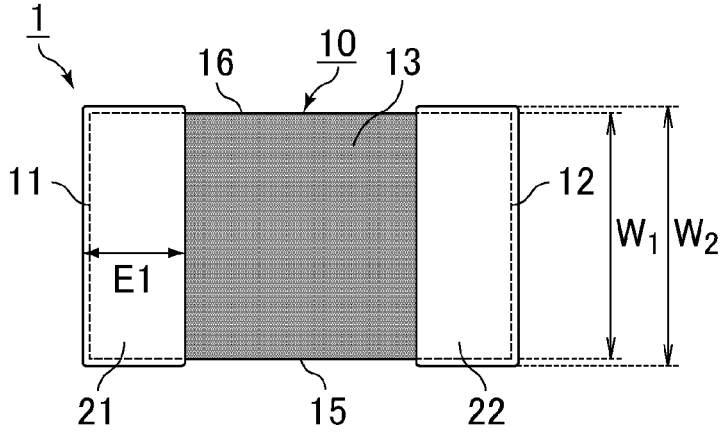
FIG. 2C is a bottom view of the multilayer coil component illustrated in FIG. 1.

FIG. 1 is a perspective view schematically illustrating a multilayer coil component according to an embodiment of the present disclosure. FIG. 2A is a side view of the multilayer coil component illustrated in FIG. 1, FIG. 2B is a front view of the multilayer coil component illustrated in FIG. 1, FIG. 2C is a bottom view of the multilayer coil component illustrated in FIG. 1, and FIG. 2D is a sectional view of the multilayer coil component illustrated in FIG. 1.

Figure 2D:
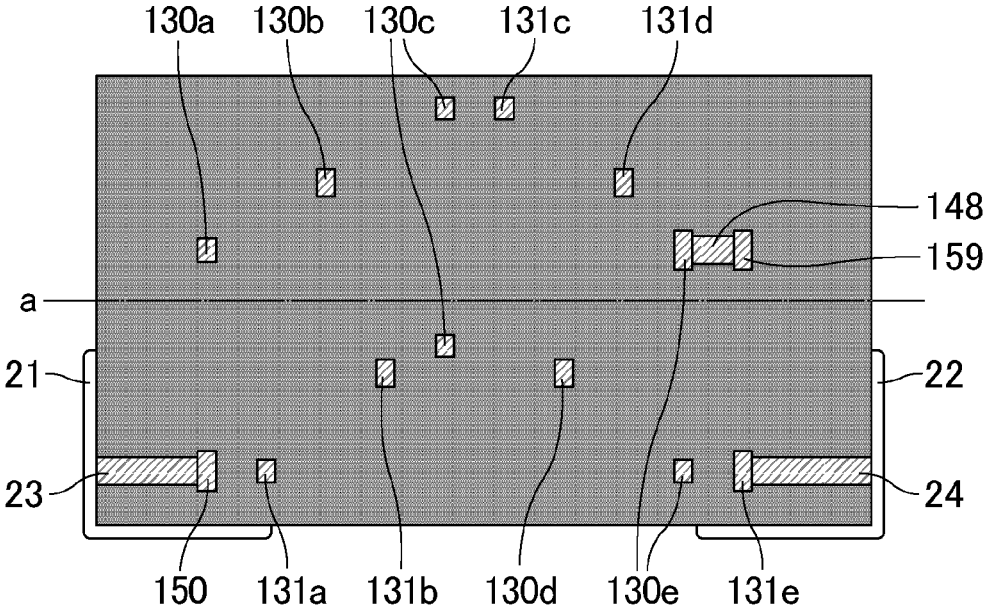
FIG. 2D is a cross-sectional view of the multilayer coil component illustrated in FIG. 1.

A multilayer coil component 1 illustrated in FIGS. 1 and 2A-2D includes a multilayer body 10, a first outer electrode 21, and a second outer electrode 22. The multilayer body 10 has a substantially rectangular parallelepiped shape having six surfaces. The configuration of the multilayer body 10 will be described later, but the multilayer body 10 is formed by stacking a plurality of insulating layers on top of one another and has a coil built into the inside thereof. The first outer electrode 21 and the second outer electrode 22 are electrically connected to the coil by, for example, a first connection conductor 23 and a second connection conductor 24, respectively, which are shown in FIG. 2D and discussed in more detail below.

In the multilayer coil component 1 and the multilayer body 10 of the embodiment of the present disclosure, a length direction, a height direction, and a width direction are an x direction, a y direction, and a z direction, respectively, in FIG. 1. Here, the length direction (x direction), the height direction (y direction), and a width direction (z direction) are perpendicular to each other.

As illustrated in FIGS. 1 and 2A-2D, the multilayer body 10 has a first end surface 11 and a second end surface 12, which face each other in the length direction (x direction), a first main surface 13 and a second main surface 14, which face each other in the height direction (y direction) perpendicular to the length direction, and a first side surface 15 and a second side surface 16, which face each other in the width direction (z direction) perpendicular to the length direction and the height direction.

As illustrated in FIG. 1, in the multilayer body 10, a coil axis a is assumed that is parallel to the length direction (x direction) and penetrates from the first end surface 11 to the second end surface 12. The direction in which the coil axis a extends is the axial direction of the coil that is built into the multilayer body 10. The axial direction of the coil and the stacking direction of the multilayer body 10 are parallel to the first main surface 13, which is a mounting surface. In addition, the coil axis a passes through the center of a polygonal shape formed by connecting the centers of the individual coil conductors in a plan view from the stacking direction, which is described later.

Although not illustrated in FIG. 1, corner portions and edge portions of the multilayer body 10 are preferably rounded. The term "corner portion" refers to a part of the multilayer body 10 where three surfaces intersect and the term "edge portion" refers to a part of the multilayer body 10 where two surfaces intersect.

The first outer electrode 21 is arranged so as to cover part of the first end surface 11 of the multilayer body 10 as illustrated in FIGS. 1 and 2B and so as to extend from the first end surface 11 and cover part of the first main surface 13 of the multilayer body 10, as illustrated in FIGS. 1 and 2C. As illustrated in FIG. 2B, the first outer electrode 21 covers a region of the first end surface 11 that includes the edge portion that intersects the first main surface 13, but does not cover a region of the first end surface 11 that includes the edge portion that intersects the second main surface 14. Therefore, the first end surface 11 is exposed in the region including the edge portion that intersects the second main surface 14. In addition, the first outer electrode 21 does not cover the second main surface 14. Since part of the first end surface 11 is not covered by the first outer electrode 21, stray capacitances can be reduced and radio-frequency characteristics can be improved compared with a multilayer coil component in which the entire first end surface is covered by the first outer electrode.

In FIG. 2B, a height E2 of the part of the first outer electrode 21 that covers the first end surface 11 of the multilayer body 10 is constant, but the shape of the first outer electrode 21 is not particularly limited so long as the first outer electrode 21 covers part of the first end surface 11 of the multilayer body 10. For example, the first outer electrode 21 may have an arch-like shape that increases in height from the ends thereof toward the center thereof on the first end surface 11 of the multilayer body 10. In addition, in FIG. 2C, a length E1 of the part of the first outer electrode 21 that covers the first main surface 13 of the multilayer body 10 is constant, but the shape of the first outer electrode 21 is not particularly limited so long as the first outer electrode 21 covers part of the first main surface 13 of the multilayer body 10. For example, the first outer electrode 21 may have an arch-like shape that increases in length from the ends thereof toward the center thereof on the first main surface 13 of the multilayer body 10.

As illustrated in FIGS. 1 and 2A, the first outer electrode 21 may be additionally arranged so as to extend from the first end surface 11 and the first main surface 13 and cover part of the first side surface 15 and part of the second side surface 16. In this case, as illustrated in FIG. 2A, the parts of the first outer electrode 21 covering the first side surface 15 and the second side surface 16 are preferably formed in a diagonal shape relative to both the edge portion that intersects the first end surface 11 and the edge portion that intersects the first main surface 13. However, the first outer electrode 21 does not have to be arranged so as to cover part of the first side surface 15 and part of the second side surface 16.

The second outer electrode 22 is arranged so as to cover part of the second end surface 12 of the multilayer body 10 and so as to extend from the second end surface 12 and cover part of the first main surface 13 of the multilayer body 10. Similarly to the first outer electrode 21, the second outer electrode 22 covers a region of the second end surface 12 that includes the edge portion that intersects the first main surface 13, but does not cover a region of the second end surface 12 that includes the edge portion that intersects the second main surface 14. Therefore, the second end surface 12 is exposed in the region including the edge portion that intersects the second main surface 14. In addition, the second outer electrode 22 does not cover the second main surface 14. Since part of the second end surface 12 is not covered by the second outer electrode 22, stray capacitances can be reduced and radio-frequency characteristics can be improved compared with a multilayer coil component in which the entire second end surface is covered by the second outer electrode.

Similarly to the first outer electrode 21, the shape of the second outer electrode 22 is not particularly limited so long as the second outer electrode 22 covers part of the second end surface 12 of the multilayer body 10. For example, the second outer electrode 22 may have an arch-like shape that increases in height from the ends thereof toward the center thereof on the second end surface 12 of the multilayer body 10. Furthermore, the shape of the second outer electrode 22 is not particularly limited so long as the second outer electrode 22 covers part of the first main surface 13 of the multilayer body 10. For example, the second outer electrode 22 may have an arch-like shape that increases in length from the ends thereof toward the center thereof on the first main surface 13 of the multilayer body 10.

Similarly to the first outer electrode 21, the second outer electrode 22 may be additionally arranged so as to extend from the second end surface 12 and the first main surface 13 and cover part of the first side surface 15 and part of the second side surface 16. In this case, the parts of the second outer electrode 22 covering the first side surface 15 and the second side surface 16 are preferably formed in a diagonal shape relative to both the edge portion that intersects the second end surface 12 and the edge portion that intersects the first main surface 13. However, the second outer electrode 22 does not have to be arranged so as to cover part of the first side surface 15 and part of the second side surface 16.

The first outer electrode 21 and the second outer electrode 22 are arranged in the manner described above, and therefore the first main surface 13 of the multilayer body 10 serves as a mounting surface when the multilayer coil component 1 is mounted on a substrate.

Although the size of the multilayer coil component 1 according to the embodiment of the present disclosure is not particularly limited, the multilayer coil component 1 is preferably the 0603 size, the 0402 size, or the 1005 size.

In the case where the multilayer coil component 1 according to the embodiment of the present disclosure is the 0603 size, the length of the multilayer body 10 (length indicated by double-headed arrow $L_1$ in FIG. 2A) preferably lies in a range from around 0.57 mm to 0.63 mm. In the case where the multilayer coil component 1 according to the embodiment of the present disclosure is the 0603 size, the width of the multilayer body 10 (length indicated by double-headed arrow $W_1$ in FIG. 2C) preferably lies in a range of around 0.27 mm to 0.33 mm. In the case where the multilayer coil component 1 according to the embodiment of the present disclosure is the 0603 size, the height of the multilayer body 10 (length indicated by double-headed arrow $T_1$ in FIG. 2B) preferably lies in a range of around 0.27 mm to 0.33 mm.

In the case where the multilayer coil component 1 according to the embodiment of the present disclosure is the 0603 size, the length of the multilayer coil component 1 (length indicated by double arrow $L_2$ in FIG. 2A) preferably lies in a range of around 0.57 mm to 0.63 mm. In the case where the multilayer coil component 1 according to the embodiment of the present disclosure is the 0603 size, the width of the multilayer coil component 1 (length indicated by double-headed arrow $W_2$ in FIG. 2C) preferably lies in a range of around 0.27 mm to 0.33 mm. In the case where the multilayer coil component 1 according to the embodiment of the present disclosure is the 0603 size, the height of the multilayer coil component 1 (length indicated by double-headed arrow $T_2$ in FIG. 2B) preferably lies in a range of around 0.27 mm to 0.33 mm.

In the case where the multilayer coil component 1 according to the embodiment of the present disclosure is the 0603 size, the length of the part of the first outer electrode 21 that covers the first main surface 13 of the multilayer body 10 (length indicated by double-headed arrow E1 in FIG. 2C) preferably lies in a range of around 0.12 mm to 0.22 mm. Similarly, the length of the part of the second outer electrode 22 that covers the first main surface 13 of the multilayer body 10 preferably lies in a range of around 0.12 mm to 0.22 mm Additionally, in the case where the length of the part of the first outer electrode 21 that covers the first main surface 13 of the multilayer body 10 and the length of the part of the second outer electrode 22 that covers the first main surface 13 of the multilayer body 10 are not constant, it is preferable that the lengths of the longest parts thereof lie within the above-described range.

In the case where the multilayer coil component 1 according to the embodiment of the present disclosure is the 0603 size, the height of the part of the first outer electrode 21 that covers the first end surface 11 of the multilayer body 10 (length indicated by double-headed arrow E2 in FIG. 2B) preferably lies in a range of around 0.10 mm to 0.20 mm. Similarly, the height of the part of the second outer electrode 22 that covers the second end surface 12 of the multilayer body 10 preferably lies in a range of around 0.10 mm to 0.20 mm. In this case, stray capacitances arising from the outer electrodes 21 and 22 can be reduced. In the case where the height of the part of the first outer electrode 21 that covers the first end surface 11 of the multilayer body 10 and the height of the part of the second outer electrode 22 that covers the second end surface 12 of the multilayer body 10 are not constant, it is preferable that the heights of the highest parts thereof lie within the above-described range.

In the case where the multilayer coil component 1 according to the embodiment of the present disclosure is the 0402 size, the length of the multilayer body 10 preferably lies in a range of around 0.38 mm to 0.42 mm and the width of the multilayer body 10 preferably lies in a range of around 0.18 mm to 0.22 mm. In the case where the multilayer coil component 1 according to the embodiment of the present disclosure is the 0402 size, the height of the multilayer body 10 preferably lies in a range of around 0.18 mm to 0.22 mm.

In the case where the multilayer coil component 1 according to the embodiment of the present disclosure is the 0402 size, the length of the multilayer coil component 1 preferably lies in a range of around 0.38 mm to 0.42 mm. In the case where the multilayer coil component 1 according to the embodiment of the present disclosure is the 0402 size, the width of the multilayer coil component 1 preferably lies in a range of around 0.18 mm to 0.22 mm. In the case where the multilayer coil component 1 according to the embodiment of the present disclosure is the 0402 size, the height of the multilayer coil component 1 preferably lies in a range of around 0.18 mm to 0.22 mm.

In the case where the multilayer coil component 1 according to the embodiment of the present disclosure is the 0402 size, the length of the part of the first outer electrode 21 that covers the first main surface 13 of the multilayer body 10 preferably lies in a range of around 0.08 mm to 0.15 mm. Similarly, the length of the part of the second outer electrode 22 that covers the first main surface 13 of the multilayer body 10 preferably lies in a range of around 0.08 mm to 0.15 mm.

In the case where the multilayer coil component 1 according to the embodiment of the present disclosure is the 0402 size, the height of the part of the first outer electrode 21 that covers the first end surface 11 of the multilayer body 10 preferably lies in a range of around 0.06 mm to 0.13 mm. Similarly, the height of the part of the second outer electrode 22 that covers the second end surface 12 of the multilayer body 10 preferably lies in a range of around 0.06 mm to 0.13 mm. In this case, stray capacitances arising from the outer electrodes 21 and 22 can be reduced.

In the case where the multilayer coil component 1 according to the embodiment of the present disclosure is the 1005 size, the length of the multilayer body 10 preferably lies in a range of around 0.95 mm to 1.05 mm and the width of the multilayer body 10 preferably lies in a range of around 0.45 mm to 0.55 mm. In the case where the multilayer coil component 1 according to the embodiment of the present disclosure is the 1005 size, the height of the multilayer body 10 preferably lies in a range of around 0.45 mm to 0.55 mm.

In the case where the multilayer coil component 1 according to the embodiment of the present disclosure is the 1005 size, the length of the multilayer coil component 1 preferably lies in a range of around 0.95 mm to 1.05 mm. In the case where the multilayer coil component 1 according to the embodiment of the present disclosure is the 1005 size, the width of the multilayer coil component 1 preferably lies in a range of around 0.45 mm to 0.55 mm. In the case where the multilayer coil component 1 according to the embodiment of the present disclosure is the 1005 size, the height of the multilayer coil component 1 preferably lies in a range of around 0.45 mm to 0.55 mm.

In the case where the multilayer coil component 1 according to the embodiment of the present disclosure is the 1005 size, the length of the part of the first outer electrode 21 that covers the first main surface 13 of the multilayer body 10 preferably lies in a range of around 0.20 mm to 0.38 mm. Similarly, the length of the part of the second outer electrode 22 that covers the first main surface 13 of the multilayer body 10 preferably lies in a range of around 0.20 mm to 0.38 mm.

In the case where the multilayer coil component 1 according to the embodiment of the present disclosure is the 1005 size, the height of the part of the first outer electrode 21 that covers the first end surface 11 of the multilayer body 10 preferably lies in a range of around 0.15 mm to 0.33 mm. Similarly, the height of the part of the second outer electrode 22 that covers the second end surface 12 of the multilayer body 10 preferably lies in a range of around 0.15 mm to 0.33 mm. In this case, stray capacitances arising from the outer electrodes 21 and 22 can be reduced.

The coil that is built into the multilayer body 10 of the multilayer coil component 1 according to the embodiment of the present disclosure will be described next.

The coil is formed by electrically connecting a plurality of coil conductors, which are stacked together with insulating layers, to one another.

Figure 3:
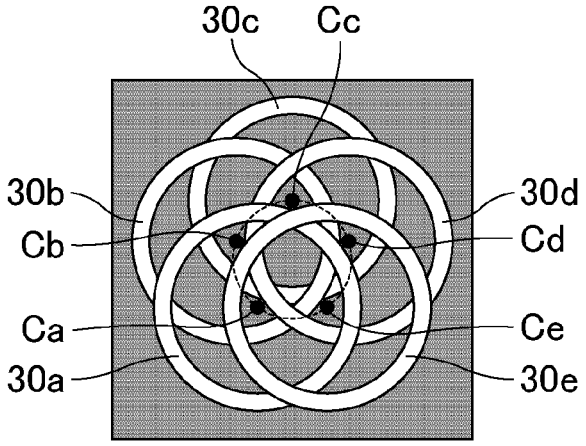
FIG. 3 is a diagram schematically illustrating repeating shapes of coil conductors in the multilayer coil component illustrated in FIG. 1.

FIG. 3 is a diagram schematically illustrating repeating shapes of coil conductors in the multilayer coil component 1 illustrated in FIG. 1. As illustrated in FIG. 3, the multilayer body 10 of the multilayer coil component 1 includes a first coil conductor 30*a*, a second coil conductor 30*b*, a third coil conductor 30*c*, a fourth coil conductor 30*d*, and a fifth coil conductor 30*e* (hereafter, also collectively referred to as coil conductors). FIG. 3 is a diagram for explaining the positional relationship between the coil conductors. Therefore, although the coil conductors are depicted as being in the same plane, in reality the coil conductors would not be in the same plane. In addition, the shapes of the coil conductors illustrated in FIG. 3 are schematically illustrated as repeating shapes formed by a plurality of coil conductors, but this does not mean that the coil conductors have circular shapes in the same plane. As illustrated in FIG. 3, the repeating shapes of the coil conductors are substantially circular shapes.

Figure 4A:
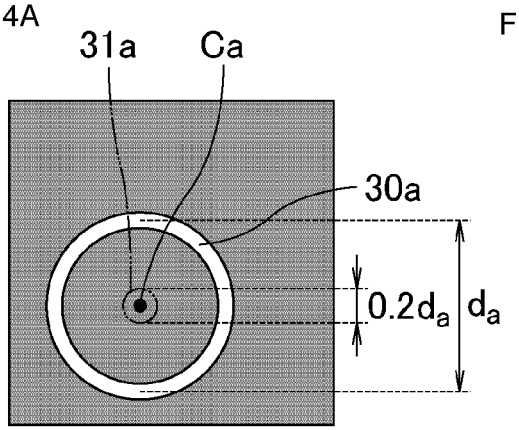
FIGS. 4A to 4E are schematic diagrams illustrating the coil conductors illustrated in FIG. 3
Figure 4B:
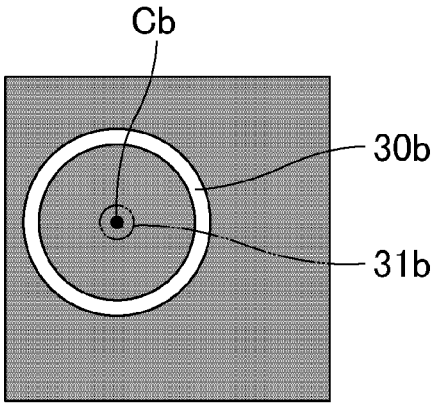
Figure 4C:
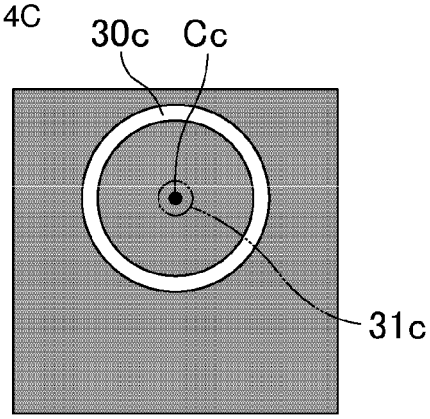
Figure 4D:
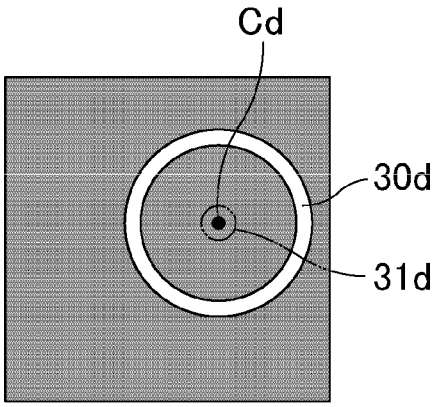
Figure 4E:
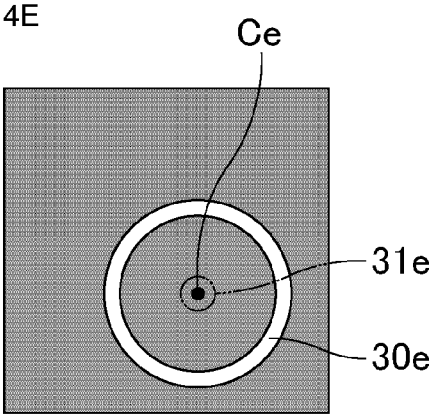
Figure 4F:
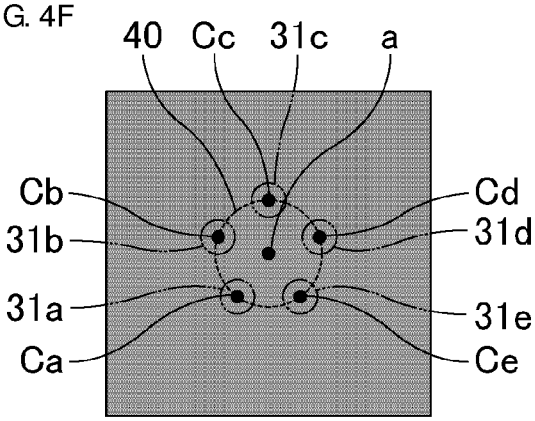
FIG. 4F is a schematic diagram for explaining the positional relationship between the centers of the coil conductors and the coil axis illustrated in FIGS. 4A to 4E.

Next, the positional relationship between the coil conductors will be described while referring to FIGS. 4A to 4F. FIGS. 4A to 4E are schematic diagrams illustrating the coil conductors illustrated in FIG. 3 and FIG. 4F is a schematic diagram for explaining the positional relationship between the centers of the coil conductors and the coil axis a illustrated in FIGS. 4A to 4E. As illustrated in FIG. 4A, a circle 31*a* is assumed that is centered on a center Ca of the first coil conductor 30*a* and that has a diameter that is around 20% a coil diameter da (0.2 da). In FIGS. 4B to 4E, similarly to as in FIG. 4A, circles 31*b*, 31*c*, 31*d*, and 31*e* (hereafter also referred to as coil conductor center circles) are assumed that are centered on center points Cb, Cc, Cd, and Ce of the coil conductors 30*b*, 30*c*, 30*d*, and 30*e* and that have diameters that are around 20% the coil diameter da. Similarly to as in FIG. 3, the coil conductors 30*a*, 30*b*, 30*c*, 30*d*, and 30*e* illustrated in FIGS. 4A to 4E are schematically illustrated as repeating shapes formed of a plurality of coil conductors.

As illustrated in FIG. 4F, the coil conductors 30*a*, 30*b*, 30*c*, 30*d*, and 30*e* are respectively centered on Ca, Cb, Cc, Cd, and Ce, which are the centers of the coil conductors 30*a*, 30*b*, 30*c*, 30*d*, and 30*e*, and the coil conductors 30*a*, 30*b*, 30*c*, 30*d*, and 30*e* are arranged so that the coil conductor center circles 31*a*, 31*b*, 31*c*, 31*d*, and 31*e* overlap the circumference of an imaginary circle 40 (a virtual circle) centered on the coil axis a (hereafter, also referred to as coil axis imaginary circle). For example, the coil diameter of the first coil conductor 30*a* illustrated in FIG. 4A is da, and the coil conductor center circle 31*a*, which is centered on the center point Ca of the first coil conductor 30*a* and has a diameter that is around 20% the coil diameter da (i.e., 0.2 da), overlaps the circumference of the coil axis imaginary circle 40, which is centered on the coil axis a. More specifically, the coil conductor center circle 31*a* overlaps the circumference of the coil axis imaginary circle 40. Although not illustrated in FIGS. 4B to 4E, the diameter of each coil conductor center circle is around 20% the coil diameter, as in FIG. 4A. In addition, the coil axis a extends through the center of a polygon having Ca, Cb, Cc, Cd, and Ce, which are the centers of the coil conductors, as the vertices thereof.

Since the coil obtained by connecting the coil conductors illustrated in FIGS. 4A to 4E is arranged so that the coil conductor center circles overlap the circumference of the coil axis imaginary circle 40, the overlapping areas of the coil conductors are smaller than in the case of a normal coil in which identical coil conductors are arranged so that the centers thereof are aligned. Therefore, stray capacitances are lower than in a normal coil and the radio-frequency characteristics can be improved. Furthermore, the coupling coefficient between the coil conductors is changed as a result of the centers of adjacent coil conductors being shifted relative to each other and the radio-frequency characteristics can be improved. In addition, the volume of the device can be reduced compared with the case where a method is used in which the coil conductors are shifted relative to each other in one direction.

In the multilayer coil component 1 according to the embodiment of the present disclosure, it is preferable that the coil conductor center circles having a diameter that is less than or equal to around 20% the coil diameter overlap the circumference of the coil axis imaginary circle 40 but the centers of the coil conductors do not have to lie on the circumference of the coil axis imaginary circle 40.

The number of different coil conductors forming the coil is not particularly limited provided that there are at least two different coil conductors, but there are preferably three or more different coil conductors, more preferably four or more different coil conductors, and still more preferably five or more different coil conductors. In this specification, coil conductors having different coil diameters and/or centers are referred to as different coil conductors. For example, in the example in FIG. 3, five different coil conductors are used.

When a coil conductor includes a land, the shape of the coil conductor is the shape obtained by removing the land.

Although the area of the coil axis imaginary circle 40 is not particularly limited, the area preferably lies in a range of around 3% to 20% of the cross sectional area of the multilayer body 10. When the area of the coil axis imaginary circle 40 is less than around 3% of the cross sectional area of the multilayer body 10, the size of the coil axis imaginary circle 40 is too small and the improvement of the radio-frequency characteristics resulting from the displacement of the coil conductors from each other may be insufficient. On the other hand, in the case where the area of the coil axis imaginary circle 40 exceeds around 20% of the cross sectional area of the multilayer body 10, it is not possible to increase the coil diameter of the coil conductors and it may not be possible to obtain a satisfactory inductance. The cross sectional area of the multilayer body 10 is obtained by dividing the total area of the first end surface 11 and the second end surface 12 of the multilayer body 10 by two.

The coil axis a is parallel to the length direction and penetrates from the first end surface 11 to the second end surface 12, and furthermore the coil axis passes through the center of a polygonal shape formed by connecting the centers Ca to Ce of the coil conductors in a plan view from the stacking direction. The coil axis a may pass through or may not pass through the center of gravity of the multilayer body 10, but it is preferable that the coil axis a pass through the center of gravity of the multilayer body 10 from the viewpoint of improving inductance. As a result of the coil conductors being arranged along the circumference of a circle centered on the coil axis a, it is easy to ensure that there is a space inside the multilayer body 10 in which the coil conductors can be arranged when the coil axis passes through the center of gravity of the multilayer body 10.

All the coil conductors are arranged so that the coil conductor center circles overlap the circumference of the coil axis imaginary circle 40. Here, the ratio of the diameter of each coil conductor center circle to the coil diameter is preferably less than or equal to around 15%, more preferably less than or equal to around 10%, and still more preferably less than or equal to around 5%. In the case where the ratio of the diameter of each coil conductor center circle to the coil diameter is 0%, the centers of the coil conductors are arranged on the circumference of the coil axis imaginary circle.

The line width of the coil conductors in a plan view from the stacking direction is not particularly limited but is preferably in a range of around 10% to 30% of the width of the multilayer body 10. When the line width of the coil conductors is less than around 10% of the width of the multilayer body 10, a direct-current resistance Rdc may become large. On the other hand, when the line width of the coil conductors exceeds around 30% of the width of the multilayer body 10, the electrostatic capacitance of the coil may become large and the radio-frequency characteristics may be degraded.

In the case where the multilayer coil component 1 according to the embodiment of the present disclosure is the 0603 size, the line width of the coil conductors preferably lies in a range of around 30 μm to 90 μm and more preferably lies in a range of around 30 μm to 70 μm.

In the case where the multilayer coil component 1 according to the embodiment of the present disclosure is the 0402 size, the line width of the coil conductors preferably lies in a range of around 20 μm to 60 μm and more preferably lies in a range of around 20 μm to 50 μm.

In the case where the multilayer coil component 1 according to the embodiment of the present disclosure is the 1005 size, the line width of the coil conductors preferably lies in a range of around 50 μm to 150 μm and more preferably lies in a range of around 50 μm to 120 μm.

The inner diameter of the coil conductors in a plan view from the stacking direction is not particularly limited but is preferably in a range of around 15% to 40% of the width of the multilayer body 10.

The inner diameters of the coil conductors may be different from one another or may be identical to each other, but are preferably all identical to each other.

In the case where the multilayer coil component 1 according to the embodiment of the present disclosure is the 0603 size, the inner diameter of the coil conductors preferably lies in a range of around 50 μm to 100 μm.

In the case where the multilayer coil component 1 according to the embodiment of the present disclosure is the 0402 size, the inner diameter of the coil conductors preferably lies in a range of around 30 μm to 70 μm.

In the case where the multilayer coil component 1 according to the embodiment of the present disclosure is the 1005 size, the inner diameter of the coil conductors preferably lies in a range of around 80 μm to 170 μm.

The inter coil conductor distance in the stacking direction preferably lies in a range of around 3 μm to 7 μm in the multilayer coil component 1 according to the embodiment of the present disclosure. As a result of making the inter coil conductor distance in the stacking direction lie in a range of around 3 μm to 7 μm, the number of turns of the coil can be increased and therefore the impedance can be increased. Furthermore, a transmission coefficient S21 in a radio-frequency band can also be increased as described later.

A specific example of a method of connecting the coil conductors to each other will be described while referring to FIGS. 5A to 5F and 6A to 6D. FIGS. 5A to 5F and 6A to 6D are diagrams schematically illustrating examples of coil sheets used when manufacturing the multilayer body 10 illustrated in FIG. 1. Coil sheets 200 to 209 illustrated in FIGS. 5A to 5F and 6A to 6D are sequentially stacked on top of one another and as a result a multilayer body can be obtained that includes a plurality of coil conductors having the same repeating shapes as the first coil conductor 30*a*, the second coil conductor 30*b*, the third coil conductor 30*c*, the fourth coil conductor 30*d*, and the fifth coil conductor 30*e* illustrated in FIG. 3.

As illustrated in FIGS. 5A to 5F and 6A to 6D, the coil sheets 200 to 209 respectively include coil conductors 130*a*, 131*a*, 130*b*, 131*b*, 130*c*, 131*c*, 130*d*, 131*d*, 130*e*, and 131*e*. The repeating shapes of the coil conductors 30*a*, 30*b*, 30*c*, 30*d*, and 30*e* are represented as circles 230*a*, 230*b*, 230*c*, 230*d*, and 230*e* illustrated using two-dot chain lines.

A coil conductor having the same repeating shape as the first coil conductor 30*a* illustrated in FIG. 4A can be formed by electrically connecting the coil conductor 130*a* and the coil conductor 131*a* to each other. Coil conductors having the same repeating shapes as the second coil conductor 30*b*, the third coil conductor 30*c*, the fourth coil conductor 30*d*, and the fifth coil conductor 30*e* can be formed by respectively electrically connecting the coil conductor 130*b* and the coil conductor 131*b* to each other, the coil conductor 130*c* and the coil conductor 131*c* to each other, the coil conductor 130*d* and the coil conductor 131*d* to each other, and the coil conductor 130*e* and the coil conductor 131*e* to each other in the same manner as for the coil conductor 130*a* and the coil conductor 131*a*. Therefore, a multilayer body can be obtained that has the same repeating shapes as the first coil conductor 30*a*, the second coil conductor 30*b*, the third coil conductor 30*c*, the fourth coil conductor 30*d*, and the fifth coil conductor 30*e* by sequentially stacking the coil sheets 200 to 209 on top of one another.

Figure 5A:
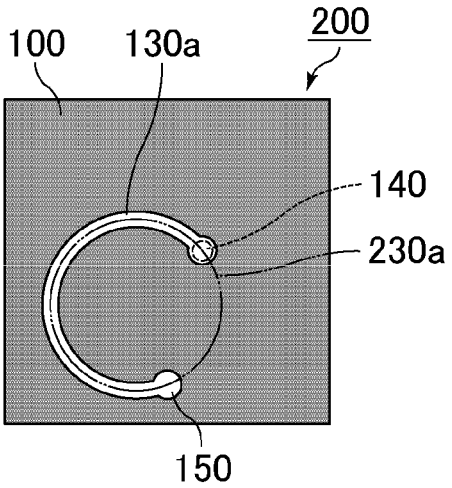
FIGS. 5A to 5F are diagrams schematically illustrating examples of coil sheets used when manufacturing the multilayer body illustrated in FIG. 1.
Figure 5B:
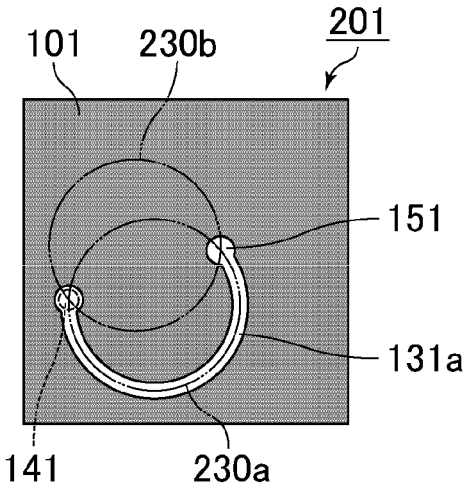

Hereafter, the configurations of specific coil sheets will be described. As illustrated in FIG. 5A, the coil sheet 200 includes the coil conductor 130*a*, which is formed on an insulating layer 100. A land 150 is provided at one end of the coil conductor 130*a* and a via conductor 140 is provided at the other end of the coil conductor 130*a*. As illustrated in FIG. 5B, the coil sheet 201 includes the coil conductor 131*a*, which is formed on an insulating layer 101. A land 151 is provided at one end of the coil conductor 131*a* and a via conductor 141 is provided at the other end of the coil conductor 131*a*. The land 151 is provided at a position where the land 151 overlaps the via conductor 140 of the coil sheet 200 in a plan view. The via conductor 141 is provided at a position where the first coil conductor 30*a* and the second coil conductor 30*b* intersect in a plan view. A coil conductor that has the same repeating shape as the first coil conductor 30*a* illustrated in FIG. 4A can be formed by stacking the coil sheet 200 and the coil sheet 201. The position of the via conductor 140 is preferably a position that enables a coil conductor having the same repeating shape as the first coil conductor 30*a* to be formed by the coil conductor 130*a* and the coil conductor 131*a*. Specifically, when the land 150 is taken to be a starting point, the via conductor 140, which is the end point, is preferably at a position that is further along in the clockwise direction than the via conductor 141 of the coil sheet 201 in a plan view.

Figure 5C:
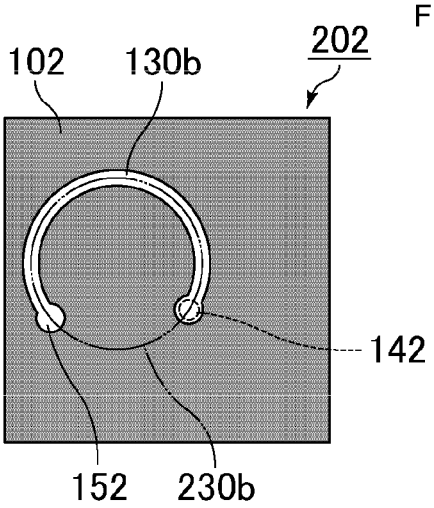
Figure 5D:
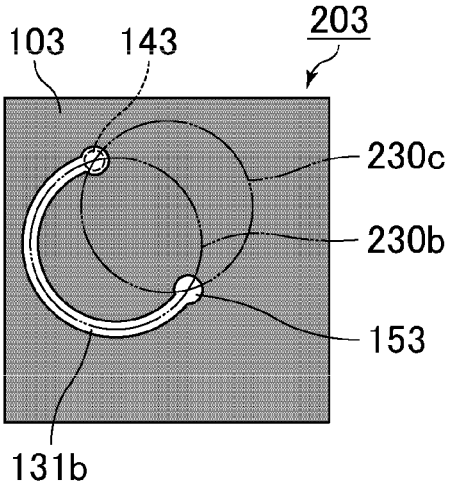

As illustrated in FIG. 5C, the coil sheet 202 includes the coil conductor 130*b*, which is formed on an insulating layer 102. A land 152 is provided at one end of the coil conductor 130*b* and a via conductor 142 is provided at the other end of the coil conductor 130*b*. The land 152 is provided at a position at which the land 152 overlaps the via conductor 141 of the coil sheet 201 in a plan view. As illustrated in FIG. 5D, the coil sheet 203 includes the coil conductor 131*b*, which is formed on an insulating layer 103. A land 153 is provided at one end of the coil conductor 131*b* and a via conductor 143 is provided at the other end of the coil conductor 131*b*. The land 153 is provided at a position at which the land 153 overlaps the via conductor 142 of the coil sheet 202 in a plan view. The via conductor 143 is provided at a position at which the second coil conductor 30*b* and the third coil conductor 30*c* intersect in a plan view. A coil conductor that has the same repeating shape as the second coil conductor 30*b* illustrated in FIG. 4B can be formed by stacking the coil sheet 202 and the coil sheet 203. The position of the via conductor 142 is preferably a position that enables a coil conductor having the same repeating shape as the second coil conductor 30*b* to be formed by the coil conductor 130*b* and the coil conductor 131*b*. Specifically, when the land 152 is taken to be a starting point, the via conductor 142, which is the end point, is preferably at a position that is further along in the clockwise direction than the via conductor 143 of the coil sheet 203 in a plan view.

Figure 5E:
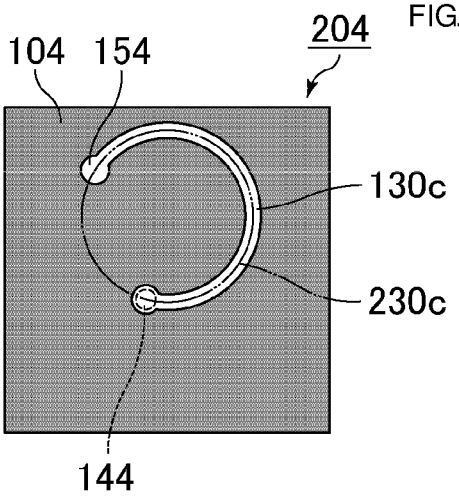
Figure 5F:
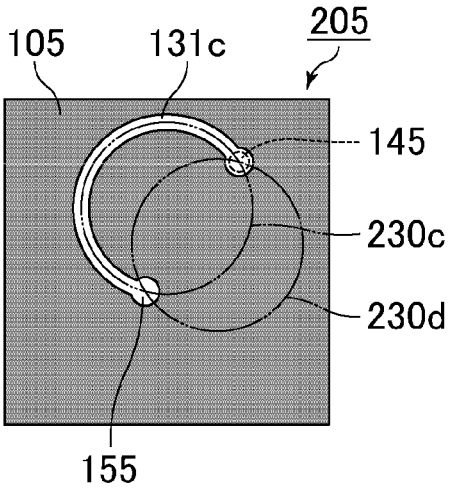

As illustrated in FIG. 5E, the coil sheet 204 includes the coil conductor 130*c*, which is formed on an insulating layer 104. A land 154 is provided at one end of the coil conductor 130*c* and a via conductor 144 is provided at the other end of the coil conductor 130*c*. The land 154 is provided at a position at which the land 154 overlaps the via conductor 143 of the coil sheet 203 in a plan view. As illustrated in FIG. 5F, the coil sheet 205 includes the coil conductor 131*c*, which is formed on an insulating layer 105. A land 155 is provided at one end of the coil conductor 131*c* and a via conductor 145 is provided at the other end of the coil conductor 131*c*. The land 155 is provided at a position at which the land 155 overlaps the via conductor 144 of the coil sheet 204 in a plan view. The via conductor 145 is provided at a position at which the third coil conductor 30*c* and the fourth coil conductor 30*d* intersect in a plan view. A coil conductor that has the same repeating shape as the third coil conductor 30*c* illustrated in FIG. 4C can be formed by stacking the coil sheet 204 and the coil sheet 205. The position of the via conductor 144 is preferably a position that enables a coil conductor having the same repeating shape as the third coil conductor 30*c* to be formed by the coil conductor 130*c* and the coil conductor 131*c*. Specifically, when the land 154 is taken to be a starting point, the via conductor 144, which is the end point, is preferably at a position that is further along in the clockwise direction than the via conductor 145 of the coil sheet 205 in a plan view.

Figure 6A:
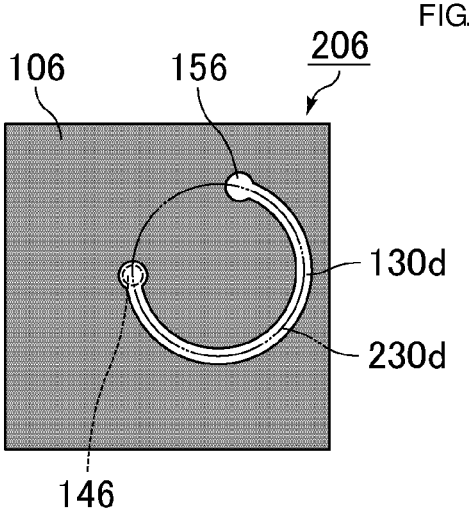
FIGS. 6A to 6D are diagrams schematically illustrating examples of coil sheets used when manufacturing the multilayer body illustrated in FIG. 1.
Figure 6B:
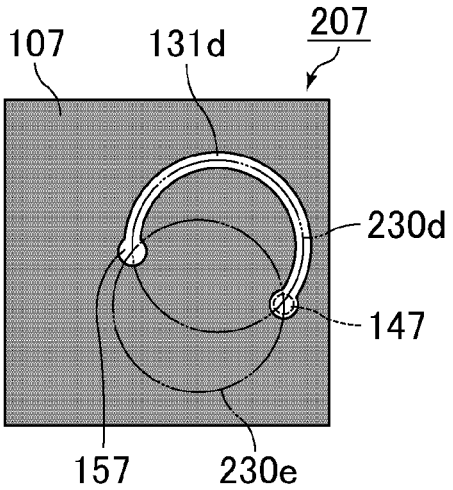

As illustrated in FIG. 6A, the coil sheet 206 includes the coil conductor 130*d*, which is formed on an insulating layer 106. A land 156 is provided at one end of the coil conductor 130*d* and a via conductor 146 is provided at the other end of the coil conductor 130*d*. The land 156 is provided at a position at which the land 156 overlaps the via conductor 145 of the coil sheet 205 in a plan view. As illustrated in FIG. 6B, the coil sheet 207 includes the coil conductor 131*d*, which is formed on an insulating layer 107. A land 157 is provided at one end of the coil conductor 131*d* and a via conductor 147 is provided at the other end of the coil conductor 131*d*. The land 157 is provided at a position at which the land 157 overlaps the via conductor 146 of the coil sheet 206 in a plan view. The via conductor 147 is provided at a position at which the fourth coil conductor 30*d* and the fifth coil conductor 30*e* intersect in a plan view. A coil conductor that has the same repeating shape as the fourth coil conductor 30*d* illustrated in FIG. 4D can be formed by stacking the coil sheet 206 and the coil sheet 207. The position of the via conductor 146 is preferably a position that enables a coil conductor having the same repeating shape as the fourth coil conductor 30*d* to be formed by the coil conductor 130*d* and the coil conductor 131*d*. Specifically, when the land 156 taken to be a starting point, the via conductor 146, which is the end point, is preferably at a position that is further along in the clockwise direction than the via conductor 147 of the coil sheet 207 in a plan view.

Figure 6C:
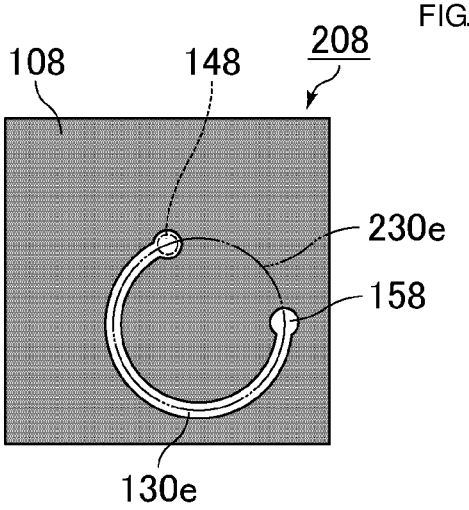
Figure 6D:
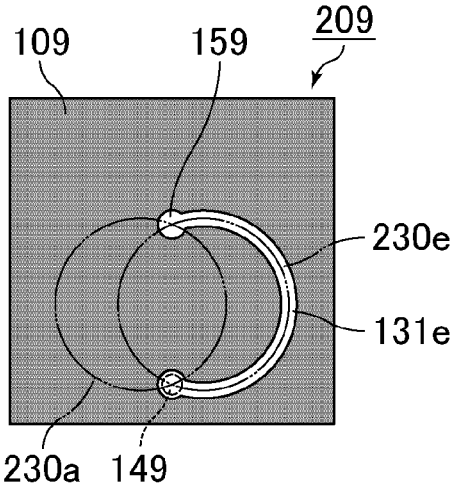

As illustrated in FIG. 6C, the coil sheet 208 includes the coil conductor 130*e*, which is formed on an insulating layer 108. A land 158 is provided at one end of the coil conductor 130*e* and a via conductor 148 is provided at the other end of the coil conductor 130*e*. The land 158 is provided at a position at which the land 158 overlaps the via conductor 147 of the coil sheet 207 in a plan view. As illustrated in FIG. 6D, the coil sheet 209 includes the coil conductor 131*e*, which is formed on an insulating layer 109. A land 159 is provided at one end of the coil conductor 131*e* and a via conductor 149 is provided at the other end of the coil conductor 131*e*. The land 159 is provided at a position at which the land 159 overlaps the via conductor 148 of the coil sheet 208 in a plan view. The via conductor 149 is provided at a position at which the fifth coil conductor 30*e* and the first coil conductor 30*a* intersect in a plan view. A coil conductor that has the same repeating shape as the fifth coil conductor 30*e* illustrated in FIG. 4E can be formed by stacking the coil sheet 208 and the coil sheet 209. The position of the via conductor 148 is preferably a position that enables a coil conductor having the same repeating shape as the fifth coil conductor 30*e* to be formed by the coil conductor 130*e* and the coil conductor 131*e*. Specifically, when the land 158 is taken to be a starting point, the via conductor 148, which is the end point, is further along in the clockwise direction than the via conductor 149 of the coil sheet 209 in a plan view.

The land 150 of the coil conductor 130*a* provided on the coil sheet 200 and the via conductor 149 of the coil conductor 131*e* provided in the coil sheet 209 are located at positions so as to overlap each other in a plan view, and therefore the number of turns of the coil can be increased by repeatedly stacking a multilayer body unit formed by stacking the coil sheets 200 to 209.

The order in which the coil conductors are arranged is not particularly limited, and for example, as illustrated in FIGS. 5A to 5F and FIGS. 6A to 6D, the coil conductors may be arranged in a repeating pattern such as one where a curved line shape formed by connecting the centers of the coil conductors has a helical shape or the coil conductors may be arranged randomly. In addition, although the repeating shape of each coil conductor is repeated one time in each set of coil sheets illustrated in FIGS. 5A to 5F and 6A to 6D, the repeating shape of the same coil conductor may instead repeat two or more times.

It is preferable that a first connection conductor and a second connection conductor be provided inside the multilayer body 10 of the multilayer coil component 1. The shapes of the first connection conductor and the second connection conductor are not especially restricted, but it is preferable that the first connection conductor and the second connection conductor be each connected in a straight line between an outer electrode and a coil conductor. By connecting the first connection conductor and the second connection conductor from the coil conductors to the outer electrodes in straight lines, lead out parts can be simplified and the radio-frequency characteristics can be improved.

In the case where the multilayer coil component 1 according to the embodiment of the present disclosure is the 0603 size, the lengths of the first connection conductor and the second connection conductor preferably lie in a range of around 15 μm to 45 μm and more preferably lie in a range of around 15 μm to 30 μm.

In the case where the multilayer coil component 1 according to the embodiment of the present disclosure is the 0402 size, the lengths of the first connection conductor and the second connection conductor preferably lie in a range of around 10 μm to 30 μm and more preferably lie in a range of around 10 μm to 25 μm.

In the case where the multilayer coil component 1 according to the embodiment of the present disclosure is the 1005 size, the lengths of the first connection conductor and the second connection conductor preferably lie in a range of around 25 μm to 75 μm and more preferably lie in a range of around 25 μm to 50 μm.

It is preferable that the first connection conductor 23 and the second connection conductor 24 (See FIG. 2D) overlap the coil conductors in a plan view from the stacking direction and be positioned closer to the mounting surface than the center axes of the coil conductors. The center axes of the coil conductors are coil axes that are parallel to the length direction and pass though the center of gravity of the multilayer body 10. For example, in a multilayer body obtained by stacking the coil sheets illustrated in FIGS. 5A to 5F and FIGS. 6A to 6D on top of one another, the surface of the multilayer body that is closest to the land 150 illustrated in FIG. 5A and the via conductor 149 illustrated in FIG. 6D serves as a mounting surface and the positions of the connection conductors are located closer to the mounting surface than the center axes of the connection conductors.

Provided that via conductors forming a connection conductor overlap in a plan view from the stacking direction, the via conductors forming the connection conductor do not have to be precisely aligned in a straight line.

The width of the first connection conductor and the width of the second connection conductor preferably each lie in a range of around 8% to 20% of the width of the multilayer body 10. The "width of the connection conductor" refers to the width of the narrowest part of the connection conductor. That is, when a connection conductor includes a land, the shape of the connection conductor is the shape obtained by removing the land.

In the case where the multilayer coil component 1 according to the embodiment of the present disclosure is the 0603 size, the widths of the connection conductors preferably lie in a range of around 30 μm to 60 μm.

In the case where the multilayer coil component 1 according to the embodiment of the present disclosure is the 0402 size, the widths of the connection conductors preferably lie in a range of around 20 μm to 40 μm.

In the case where the multilayer coil component 1 according to the embodiment of the present disclosure is the 1005 size, the widths of the connection conductors preferably lie in a range of around 40 μm to 100 μm.

In the multilayer coil component 1 according to the embodiment of the present disclosure, the lengths of the first connection conductor and the second connection conductor preferably lie in a range of around 2.5% to 7.5% of the length of the multilayer body 10 and more preferably lie in a range of around 2.5% to 5.0% of the length of the multilayer body 10.

In the multilayer coil component 1 according to the embodiment of the present disclosure, there may be two or more of the first connection conductor and the second connection conductor. A case where there are two or more connection conductors indicates a state where a part of an outer electrode covering an end surface and the coil conductor facing that outer electrode are connected to each other in at least two places by the connection conductors.

The multilayer coil component 1 according to the embodiment of the present disclosure has excellent radio-frequency characteristics in a radio-frequency band (in particular, in a range of around 30 GHz to 80 GHz). Specifically, the transmission coefficient S21 at around 40 GHz preferably lies in a range of around −1 dB to 0 dB and the transmission coefficient S21 at around 50 GHz preferably lies in a range of around −2 dB to 0 dB. The transmission coefficient S21 is obtained from a ratio of the power of a transmitted signal to the power of an input signal. The transmission coefficient S21 is basically a dimensionless quantity, but is usually expressed in dB using the common logarithm. When the above conditions are satisfied, for example, the multilayer coil component 1 can be suitably used in a bias tee circuit or the like inside an optical communication circuit.

Hereafter, an example of a method of manufacturing the multilayer coil component 1 according to the embodiment of the present disclosure will be described.

First, ceramic green sheets, which are insulating layers, are manufactured. For example, an organic binder such as a polyvinyl butyral resin, an organic solvent such as ethanol or toluene, and a dispersant are added to a ferrite raw material and kneaded to form a slurry. After that, magnetic sheets having a thickness of around 12 μm are obtained using a method such as a doctor blade technique.

As a ferrite raw material, for example, iron, nickel, zinc and copper oxide raw materials are mixed together and calcined at around 800° C. for around one hour, pulverized using a ball mill, and dried, and a Ni—Zn—Cu ferrite raw material (oxide mixed powder) having an average particle diameter of around 2 μm can be obtained.

As a ceramic green sheet material, which forms the insulating layers, for example, a magnetic material such as a ferrite material, a nonmagnetic material such as a glass ceramic material, or a mixed material obtained by mixing a magnetic material and a nonmagnetic material can be used. When manufacturing ceramic green sheets using a ferrite material, in order to obtain a high L value (inductance), it is preferable to use a ferrite material having a composition consisting of $Fe_2O_3$ at around 40 mol % to 49.5 mol %, ZnO at around 5 mol % to 35 mol %, CuO at around 4 mol % to 12 mol %, and the remainder consisting of NiO and trace amounts of additives (including inevitable impurities).

Via holes having a diameter of around 20 μm to 30 μm are formed by subjecting the manufactured ceramic green sheets to prescribed laser processing. Using a Ag paste on specific sheets having via holes, the coil sheets are formed by filling the via holes and screen-printing prescribed coil-looping conductor patterns (coil conductors) having a thickness of around 11 μm and drying.

The coil sheets are prepared in accordance with the types of coil conductors that are to be formed. In the case of the coil conductors illustrated in FIG. 3, for example, the ten different coil sheets illustrated in FIGS. 5A to 5F and 6A to 6D are prepared.

The coil sheets are stacked in a prescribed order so that a coil having a looping axis in a direction parallel to the mounting surface is formed in the multilayer body after division into individual components. In addition, via sheets, in which via conductors serving as connection conductors are formed, are stacked above and below the coil sheets. At this time, the quantities and thicknesses of the coil sheets and via sheets are preferably adjusted so that the lengths of the connection conductors both lie in a range of around 2.5% to 7.5% of the length of the multilayer body 10.

The multilayer body is subjected to thermal pressure bonding in order to obtain a pressure-bonded body, and then the pressure-bonded body is cut into pieces of a predetermined chip size to obtain individual chips. The divided chips may be processed using a rotary barrel in order to round the corner portions and edge portions thereof.

Binder removal and firing is performed at a predetermined temperature and for a predetermined period of time, and fired bodies (multilayer bodies) having a built-in coil are obtained.

The chips are dipped at an angle in a layer obtained by spreading a Ag paste to a predetermined thickness and baked to form a base electrode for an outer electrode on four surfaces (a main surface, an end surface, and both side surfaces) of the multilayer body. In the above-described method, the base electrode can be formed in one go in contrast to the case where the base electrode is formed separately on the main surface and the end surface of the multilayer body in two steps.

Formation of the outer electrodes is completed by sequentially forming a Ni film and a Sn film having predetermined thicknesses on the base electrodes by performing plating. The multilayer coil component 1 according to the embodiment of the present disclosure can be manufactured as described above.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A multilayer coil component comprising:

a multilayer body that is formed by stacking a plurality of insulating layers on top of one another and that has a coil built into the inside thereof, the coil being formed by electrically connecting a plurality of coil conductors, which are stacked together with insulating layers, to one another, and the multilayer body has a first end surface and a second end surface, which face each other in a length direction, a first main surface and a second main surface, which face each other in a height direction perpendicular to the length direction, the first main surface being a mounting surface, and a stacking direction of the multilayer body and an axial direction of the coil are parallel to the mounting surface, and a first side surface and a second side surface, which face each other in a width direction perpendicular to the length direction and the height direction; and a first outer electrode and a second outer electrode that are electrically connected to the coil, the first outer electrode being arranged so as to cover part of the first end surface and so as to extend from the first end surface and cover part of the first main surface, and the second outer electrode being arranged so as to cover part of the second end surface and so as to extend from the second end surface and cover part of the first main surface, wherein repeating shapes of the coil conductors are substantially circular shapes in a plan view in the stacking direction, and when a coil axis is assumed that is parallel to the length direction and penetrates from the first end surface to the second end surface of the multilayer body, all the coil conductors are arranged so that circles centered on center points of the coil conductors and having diameters that are less than or equal to around 20% of a coil diameter overlap a circumference of a virtual circle centered on the coil axis.

2. The multilayer coil component according to claim 1, wherein coil diameters of the coil conductors are all identical.

3. The multilayer coil component according to claim 1, further comprising:

a first connection conductor and a second connection conductor inside the multilayer body;

wherein the first connection conductor is connected in a straight line between a part of the first outer electrode that covers the first end surface and the coil conductor that faces the first outer electrode, and the second connection conductor is connected in a straight line between a part of the second outer electrode that covers the second end surface and the coil conductor that faces the second outer electrode.

4. The multilayer coil component according to claim 3, wherein the first connection conductor and the second connection conductor overlap the coil conductors in a plan view from the stacking direction and are located closer to the mounting surface than a center axis of the coil.

5. The multilayer coil component according to claim 2, further comprising:

a first connection conductor and a second connection conductor inside the multilayer body;

wherein the first connection conductor is connected in a straight line between a part of the first outer electrode that covers the first end surface and the coil conductor that faces the first outer electrode, and the second connection conductor is connected in a straight line between a part of the second outer electrode that covers the second end surface and the coil conductor that faces the second outer electrode.

6. The multilayer coil component according to claim 5, wherein the first connection conductor and the second connection conductor overlap the coil conductors in a plan view from the stacking direction and are located closer to the mounting surface than a center axis of the coil.

* * * * *